United States Patent [19]

Buckland et al.

[11] Patent Number: 4,824,771

[45] Date of Patent: Apr. 25, 1989

[54] PHOTOGRAPHIC ACETANILIDE COUPLERS WITH NOVEL BALLAST GROUP AND PHOTOGRAPHIC ELEMENTS CONTAINING THEM

[75] Inventors: Paul R. Buckland, St. Albans; John D. Goddard, Middlesex, both of United Kingdom

[73] Assignee: Eastman Kodak Company, Rochester, N.Y.

[21] Appl. No.: 114,966

[22] Filed: Oct. 30, 1987

[30] Foreign Application Priority Data

Dec. 18, 1986 [GB] United Kingdom ..... 8630304

[51] Int. Cl.[4] ..... G03C 7/36

[52] U.S. Cl. ..... 430/388; 430/389; 430/505; 430/556; 430/557

[58] Field of Search ..... 430/556, 557, 388, 389

[56] References Cited

U.S. PATENT DOCUMENTS

| | | | |
|---|---|---|---|
| 2,735,765 | 2/1956 | Loria et al. | 430/556 |
| 3,700,455 | 10/1972 | Ishikawa et al. | 430/556 |
| 4,241,172 | 12/1980 | Okaniwa et al. | 430/552 |
| 4,386,155 | 5/1983 | Bergthaller et al. | 430/372 |
| 4,443,536 | 4/1984 | Lestina | 430/552 |
| 4,503,141 | 3/1985 | Furutachi et al. | 430/557 |
| 4,511,649 | 4/1985 | Ogawa et al. | 430/557 |
| 4,513,082 | 4/1985 | Furutachi et al. | 430/556 |

FOREIGN PATENT DOCUMENTS 126433 3/1976 European Pat. Off. .

OTHER PUBLICATIONS

*Research Disclosure*, Dec. 1978, Item No. 17643, vol. 176, Kenneth Mason Publications Ltd., Hampshire, England.

*Primary Examiner*—Paul R. Michl
*Assistant Examiner*—Mark R. Buscher
*Attorney, Agent, or Firm*—Richard E. Knapp

[57] ABSTRACT

Novel photographic acetanilide dye-forming couplers comprise a group comprising a stabilizer moiety represented by the formula:

wherein $R^2$ is halogen or alkoxy having 1 to 4 carbon atoms; $R^3$ is hydrogen, halogen, alkyl or alkoxy; $R^4$, $R^5$, $R^6$ and $R^7$ are individually alkyl;

$R^8$ and $R^9$ are individually hydrogen or alkyl; $R^{10}$ is hydrogen, alkyl or aryl; and X is a linking group. Such couplers provide advantageous stability in dyes formed from the couplers. These couplers are useful in photographic silver halide materials and processes.

12 Claims, No Drawings

PHOTOGRAPHIC ACETANILIDE COUPLERS WITH NOVEL BALLAST GROUP AND PHOTOGRAPHIC ELEMENTS CONTAINING THEM

This invention relates to novel photographic acetanilide yellow dye-forming color couplers and to photographic elements containing them.

Acetanilide couplers are widely used in photographic materials as yellow dye image-formers in photographic color materials. They are described, for example, in Bailey and Williams, "The Photographic Color Development Process" in the Chemistry of Synthetic Dyes, ed. K. Venkataraman, Academic Press, Inc., New York and London, Volume 4, 341 (1971).

U.S. Pat. No. 3,700,455 describes the use of photographic image dye stabilizers of the general formula:

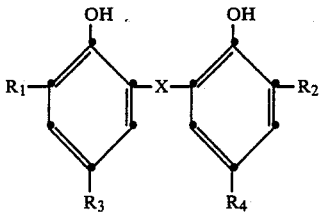

wherein $R_1$, $R_2$, $R_3$ and $R_4$ are individually a straight chain or branched-chain hydrocarbon radical having 1 to 18 carbon atoms, the total sum of carbon atoms of said $R_1$, $R_2$, $R_3$ and $R_4$ being less than 32, and X is —S—, —O—, —$SO_2$— or

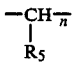

where n is an integer of 0 to 3 and $R_5$ is a hydrogen atom or a lower alkyl group.

These compounds are incorporated into sensitive photographic materials and are said to improve the light fastness of dyes formed from yellow, magenta and cyan dye-forming color couplers.

According to the present invention novel yellow couplers are provided in which a similar stabilizer moiety is employed as the ballasting group. Not only are the dyes formed more stable than dyes from couplers with conventional ballast groups but, compared to the U.S. Patent referred to above, a smaller weight of coupler and stabilizer is employed thus leading to thinner layers hence sharper images.

The described advantages are provided by a non-diffusible yellow dye-forming acetanilide coupler having a group comprising a stabilizer moiety represented by the formula:

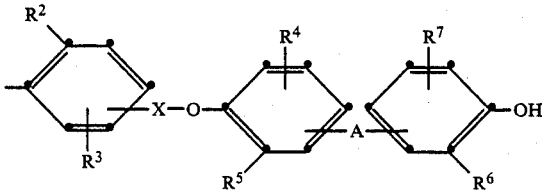

wherein $R^2$ is halogen, such as chlorine, bromine or fluorine or alkoxy having 1 to 4 carbon atoms, such as methoxy, ethoxy, propoxy and butoxy;

$R^3$ is hydrogen, halogen, such as chlorine, bromine or fluorine, alkyl, for example alkyl containing 1 to 30 carbon atoms, such as methyl, ethyl, propyl, butyl and eicosyl, or alkoxy such as methoxy, ethoxy, propoxy and butoxy;

$R^4$, $R^5$, $R^6$ and $R^7$ are each alkyl, such as alkyl containing 1 to 30 carbon atoms, for example methyl, ethyl, propyl, butyl and eicosyl;

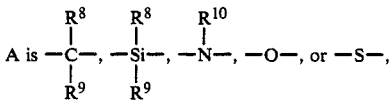

$R^8$ and $R^9$ are each hydrogen or alkyl, such as alkyl containing 1 to 30 carbon atoms;

$R^{10}$ is hydrogen, alkyl, such as alkyl containing 1 to 30 carbon atoms, for example methyl, ethyl, propyl, butyl or eicosyl, or aryl, such as unsubstituted phenyl or optionally substituted phenyl; and, X is a linking group, such as —CO— or —$OCH_2CO$—.

An illustrative non-diffusible yellow dye-forming acetanilide coupler is represented by the general formula:

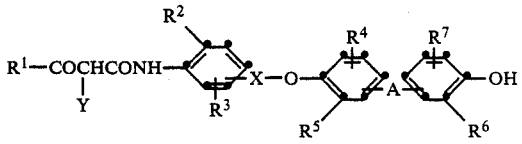

wherein $R^1$ is t-butyl or an aryl group, such as phenyl or optionally substituted phenyl, for example, p-methoxyphenyl and p-n-butoxyphenyl;

Y is hydrogen or a coupling-off group that is a group that splits off on color development; and, $R^2$, $R^3$, $R^4$, $R^5$, $R^6$, $R^7$, $R^8$, $R^{9A}$, $R^{10}$, A and X are as defined.

The present couplers, together with oxidized color developing agent, form yellow dyes of improved dye stability compared to conventionally ballasted couplers. The couplers may be prepared conveniently and inexpensively.

Preferably $R^2$ is chloro or methoxy. $R^3$ may be, for example, hydrogen, methyl, methoxy or chloro. The linking group X may be —CO—, —$SO_2$—, —$R^{11}$, —O—, —$R^{11}$—O—, —O—$R^{11}$—CO—, —$R^{11}$—O—, —O—$R^{11}$—O—, —NH—CO—$R^{11}$ or —NH— where $R^{11}$ is an alkylene or alkylidene group. Alkylene, for example, contains 1 to 4 carbon atoms, such as —$CH_2$—, —$(CH_2)_2$—, —$(CH_2)_3$— or —$(CH_2)_4$—.

Y is preferably an aryloxy or heterocyclic coupling off group, such as a phenyloxy or substituted phenyloxy group or a group of the formula:

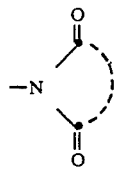

Specific examples of groups Y are:

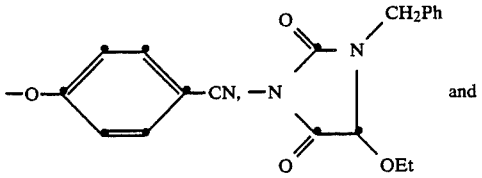

and

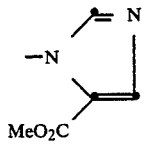

Ph herein means phenyl, Et herein means ethyl, and Me herein means methyl. Bu herein means butyl.

The present couplers may be prepared by methods in themselves known in the art. For example, they may be prepared by following the general scheme:

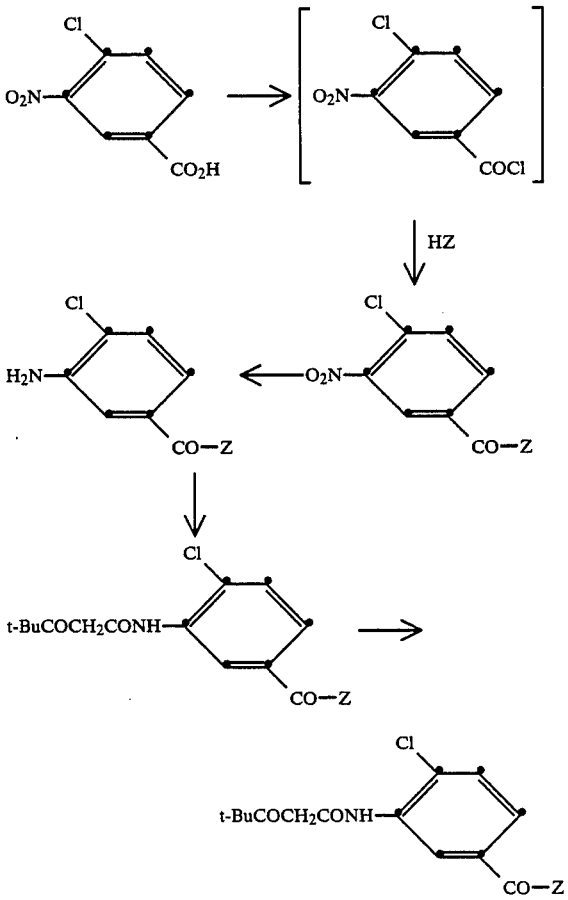

-continued

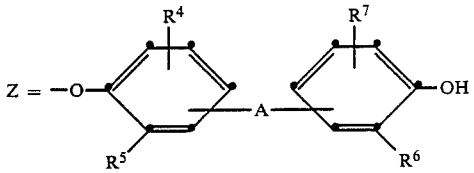

The coupling-off group Y, if present, is then incorporated by known methods.

The dye-forming couplers of this invention can be used in the ways and for the purposes that dye-forming couplers have been previously used in the photographic art. They may be dissolved in processing solutions (unballasted) or incorporated into photographic materials (normally ballasted).

Typically, the couplers are incorporated in silver halide emulsions and the emulsions coated on a support to form a photographic element. Alternatively, the couplers can be incorporated in photographic elements associated with the silver halide emulsion where, during development, the coupler will be in reactive association with development products such as oxidized color developing agent. Thus, as used herein, the term "associated with" signifies that the coupler is in the silver halide emulsion layer or in an adjacent location where, during processing, it will come into reactive association with silver halide development products.

The photographic elements can be single color elements or multicolor elements. In a multicolor element, the yellow dye-forming couplers of this invention would usually be associated with a blue-sensitive emulsion, although they could be associated with an emulsion sensitized to a different region of the spectrum, or with a panchromatically sensitized, orthochromatically sensitized or unsensitized emulsion. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art.

A typical multicolor photographic element would comprise a support bearing a yellow dye image-forming unit comprised of at least one blue-sensitive silver halide emulsion layer having associated therewith at least one yellow dye-forming coupler, at least one of the yellow dye-forming couplers being a coupler of this invention, and magenta and cyan dye image-forming units comprising at least one green- or red-sensitive silver halide emulsion layer having associated therewith at least one magenta or cyan dye-forming coupler respectively. The element can contain additional layers, such as filter layers.

In the following discussion of suitable materials for use in the emulsions and elements of this invention, reference will be made to Research Disclosure, December 1978, Item 17643, published by Industrial Opportunities Ltd., The Old Harbourmaster's, 8 North Street, Emsworth, Hants P010 7DD, U.K. This publication will be identified hereafter as "Research Disclosure".

The silver halide emulsion employed in the elements of this invention can be either negative-working or positive-working. Suitable emulsions and their preparation are described in Research Disclosure Sections I and II and the publications cited therein. Suitable vehicles for the emulsion layers and other layers of elements of this invention are described in Research Disclosure Section IX and the publications cited therein.

In addition to the couplers of this invention, the elements of the invention can include additional couplers as described in Research Disclosure Section VII, paragraphs D, E, F and G and the publications cited therein. The couplers of this invention and any additional couplers can be incorporated in the elements and emulsions as described in Research Disclosures of Section VII, paragraph C and the publications cited therein.

The photographic elements of this invention or individual layers thereof, can contain brighteners (see Research Disclosure Section V), antifoggants and stabilizers (see Research Disclosure Section VI), antistain agents and image dye stabilizer (see Research Disclosure Section VII, paragraphs I and J), light absorbing and scattering materials (see Research Disclosure Section VIII), hardeners (see Research Disclosure Section XI), plasticizers and lubricants (see Research Disclosure Section XII), antistatic agents (see Research Disclosure Section XIII), matting agents (see Research Disclosure Section XVI) and development modifiers (see Research Disclosure Section XXI).

The photographic elements can be coated on a variety of supports as described in Research Disclosure Section XVII and the references described therein.

Photographic elements can be exposed to actinic radiation, typically in the visible region of the spectrum, to form a latent image as described in Research Disclosure Section XVIII and then processed to form a visible dye image as described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

Preferred color developing agents are p-phenylene diamines. Especially preferred are 4-amino-N,N-diethylaniline hydrochloride, 4-amino-3-methyl-N-ethyl-N-β-(methanesulfonamido)-ethylaniline sulphate hydrate, 4-amino-3-methyl-N-ethyl-N-β-hydroxyethylaniline sulphate, 4-amino-3-β-(methanesulfonamido)ethyl-N,N-diethylaniline hydrochloride and 4-amino-N-ethyl-N-(2-methoxyethyl)-m-toluidine di-p-toluene sulfonate.

With negative-working silver halide emulsions this processing step leads to a negative image. To obtain a positive (or reversal) image, this step can be preceded by development with a non-chromogenic developing agent to develop exposed silver halide, but not form dye, and then uniform fogging of the element to render unexposed silver halide developable. Alternatively, a direct positive emulsion can be employed to obtain a positive image.

Development is followed by the conventional steps of bleaching, fixing, or bleach-fixing, to remove silver and silver halide, washing and drying.

Specific couplers according to the present invention are listed in Table I below are of the general formula:

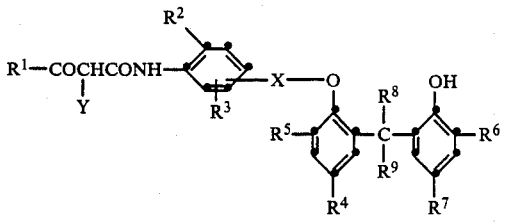

TABLE I

| Coupler | X | Y | $R^2$ | $R^3$ | $R^1 = R^4 = R^5 = R^5 = R^7$ | $R^8$ | $R^9$ |
|---|---|---|---|---|---|---|---|
| A1 | 5-CO— | 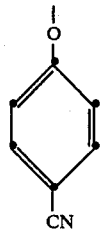 | Cl | H | t-Bu | n-Pr | H |
| A2 | 5-CO— | 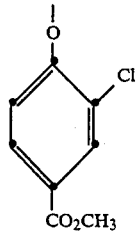 | Cl | H | t-Bu | n-Pr | H |

TABLE I-continued
| Coupler | X | Y | $R^2$ | $R^3$ | $R^1 = R^4 = R^5 = R^5 = R^7$ | $R^8$ | $R^9$ |
|---|---|---|---|---|---|---|---|
| A3 | 5-CO— | 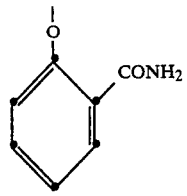 | Cl | H | t-Bu | n-Pr | H |
| A4 | 5-CO— | 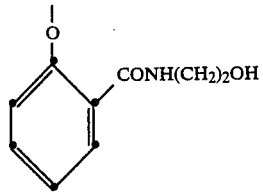 | Cl | H | t-Bu | n-Pr | H |
| A5 | 5-CO— | 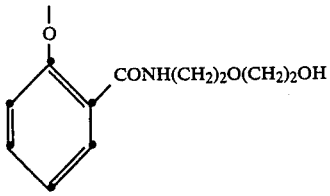 | Cl | H | t-Bu | n-Pr | H |
| A6 | 5-CO— | 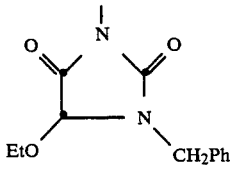 | Cl | H | t-Bu | n-Pr | H |
| A7 | 5-CO— | 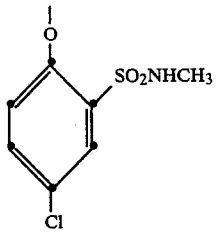 | Cl | H | t-Bu | n-Pr | H |
| A8 | 5-CO— | 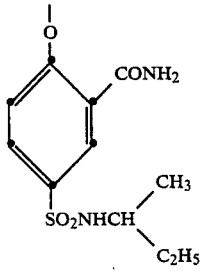 | Cl | H | t-Bu | n-Pr | H |

TABLE I-continued
| Coupler | X | Y | $R^2$ | $R^3$ | $R^1 = R^4 = R^5 = R^5 = R^7$ | $R^8$ | $R^9$ |
|---|---|---|---|---|---|---|---|
| A9 | 5-CO— | 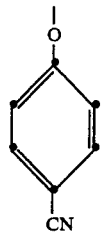 | Cl | H | t-Bu | Me | H |
| A10 | 5-CO— | 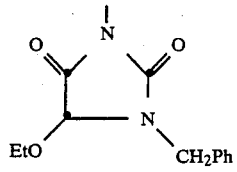 | Cl | H | t-Bu | Me | H |
| A11 | 5-CO— | 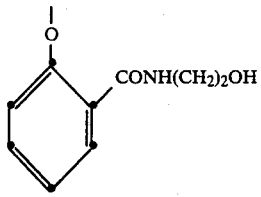 | Cl | H | t-Bu | Me | H |
| A12 | 5-$OCH_2CO$— | 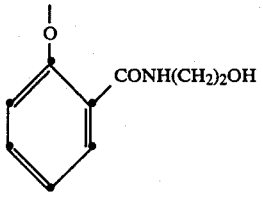 | Cl | 4-Cl | t-Bu | Me | H |
| A13 | 5-$OCH_2CO$— | 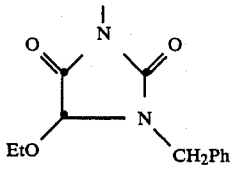 | Cl | 4-Cl | t-Bu | Me | H |
Conventially ballasted couplers representing the prior art are listed below in Table II.
TABLE II
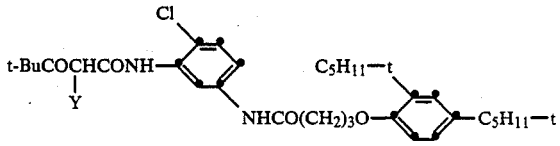
| Coupler | Y |
|---|---|

B1

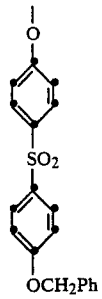

B2

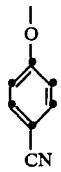

B3

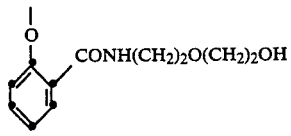

The following Examples are included for a better understanding of the invention. The words ALKANOL XC, SURFACTANT 10G, WRATTEN, and EASTMAN are trade names.

EXAMPLE 1

Preparation of Coatings

A dispersion of each coupler was prepared so as to yield 0.9 $m^2$ of coating with the following lay-downs in $mg.m^{-2}$.

| | |
|---|---|
| Coupler | 1.244 × mol wt coupler |
| Coupler solvent | 0.25 × 1.244 × mol wt coupler |
| Gelatin | 1614 |
| Silver | 365.8 |

The dispersions were prepared as follows. In a 100 ml beaker (A) is placed the coupler (2.311 mmole), the coupler solvent [(0.577×mol wt coupler)mg] and the auxiliary solvent [(3×wt of coupler used)ml]. In a second beaker (B) is placed 20.0 ml of 12.5% bone gelatin, 3 ml ALKANOL XC (10% solution) and a calculated amount of water to give a total volume (contents of (A) and (B)) of 41.6 ml (this is the calculated amount of water to give 6% gel for milling). This mixture is then kept at 40°-50° C. until used (Solution B). The contents of beaker (A) are heated gently until dissolution of coupler is complete to give Solution (A). Solution (B) is poured directly into Solution A with stirring and immediately milled twice through a colloid mill (0.1 mm setting). The mill is air blown to remove as much as possible of any residual dispersion left inside. The milled dispersion is then placed into a water bath (40°-50° C.) to defoam (about 30 min). Half (20.8 ml) of the total calculated volume of milled dispersion is used as follows. In a coating jar the following is placed:

20.8 ml milled dispersion 1.0 ml SURFACTANT 10G (spreading agent 10% soln.) Emulsion Distilled water to 60 ml.

The above is coated at 65 $ml.m^{-2}$ to yield 0.9 $m^2$ of coating. Finally, an overcoat layer containing 1076 $mg.m^{-2}$ gel and an incorporated hardener is coated on top of the dispersion layer.

Evaluation of coatings

Test coupler coatings prepared as described in Example 1, were exposed using an EASTMAN Intensity sensitometer automatic type 1B, Model IV as follows:

| | |
|---|---|
| Light temperature | 3000° K. |
| Exposure time | 0.1 second |
| Step tablet | Type M carbon, 0-3 |
| Density steps | 0.15 increment; 21 |
| Filters used with exposure | WR-98, I.R., 0.85 neutral density |

The coating strips were processed using as color developer a compound of the formula:

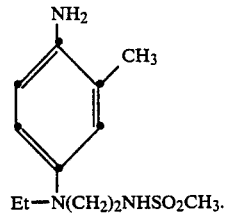

D log E curves were generated by an EASTMAN reflection densitometer with 0°-45° geometry (negative sense), 21 steps with increments of 0.15 for status A integral densities of red, green and blue.

The coating strips were then exposed to a high intensity Xenon light source at a luminous flux level of 50 klux with a WRATTEN 2B filter interposed between the light source and sample. After a suitable time, the strips were removed and the decrease in density from initial densities of 1.7, 1.0 and 0.5 were determined as a measure of the fade of each sample dye.

The results given below compare the light fastness of dyes from couplers of the present invention (A2-A7) with those of the prior art (B1-B3).

TABLE III

| | ΔD (2 weeks; 50 klux + 2B Filter) | | |
|---|---|---|---|
| Coupler | 1.7 | 1.0 | 0.5 |
| A2 | −0.08 | −0.06 | −0.06 |
| A3 | −0.09 | −0.06 | −0.06 |
| A4 | −0.07 | −0.07 | −0.07 |
| A5 | −0.06 | −0.06 | −0.07 |
| A6 | −0.08 | −0.05 | −0.04 |
| A7 | −0.08 | −0.07 | −0.07 |
| B1 | −0.21 | −0.11 | −0.10 |
| B2 | −0.13 | −0.09 | −0.08 |
| B3 | −0.14 | −0.12 | −0.12 |

EXAMPLE 2

Preparation of coupler A9 of Table I:

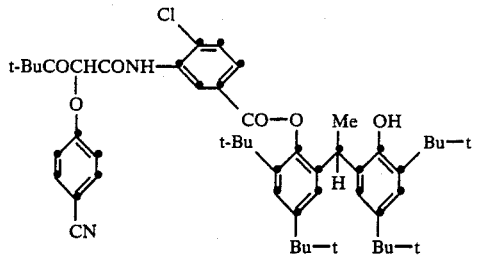

The general preparative scheme illustrated above was followed.

(a) 2,4-Di-t-butyl-6-[1-(3,5-di-t-butyl-2-hydroxyphenyl)ethyl]phenyl 4-chloro-3-nitrobenzoate. 4-Chloro-3-nitrobenzoyl chloride (53.9 g, 0.245 mole) in tetrahydrofuran (30 ml) was added with stirring to a solution of 2,4-di-t-butyl-6-[1-(3,5,-di-t-butyl-2-hydroxyphenyl)ethyl]phenol (107.4 g, 0.245 mole) in pyridine (200 ml) and tetrahydrofuran (300 ml) at room temperature over 5 min. After 4 hours the mixture was partially evaporated and poured onto an ice cold solution of water (1400 ml) and 10M hydrochloric acid 350 ml). The aqueous solution was run off and the residue dissolved in hexane (1000 ml). This solution was washed with 2M hydrochloric acid (2×100 ml), dried and the solvent removed. The residue was crystallized from methanol (600 ml) to give the product (109.8 gm; 72%) as a pale yellow solid, m.p. 157°-160°.

Found: C, 71.8; H, 7.8; Cl, 5.5; N, 2.2. $C_{37}H_{48}ClNO_5$ requires: C, 71.8; H, 7.7; Cl, 5.7; N, 2.3%.

(b) 2,4-Di-t-butyl-6-[1-(3,5-di-t-butyl-2-hydroxy phenyl)ethyl]phenyl 4-chloro-3-aminobenzoate. Iron metal powder (28.6 g, 0.52 mole) and 10M hydrochloric acid (53 ml, 0.53 mole) were added alternately over 30 min to a mixture of the nitro compound (54.0 g. 0.087 mole) from (a) in tetrahydrofuran (320 ml) and water (32 ml), heated under reflux. Heating was continued for 24 hours during which time (after 4 hours) a further portion of 10M hydrochloric acid (10 ml) was added. The mixture was filtered and the filtrate evaporated to dryness. The residue was partitioned between toluene (500 ml) and water (400 ml) and the layers separated. The toluene solution was filtered through kieselguhr, dried and evaporated to give a solid. The solid was boiled with methanol (300 ml), cooled, collected and dried to give the product (47.2 g, 92%), as a white solid, m.p. 254°-255°.

Found: C, 75.1; H, 8.6; Cl, 6.3; N, 2.3. $C_{37}H_{50}ClNO_3$ requires: C, 75.1, H, 8.5; Cl, 6.0; N, 2.4%.

(c) 2,4-Di-t-butyl-6-[1-(3,5-di-t-butyl-2-hydroxy phenyl)ethyl]phenyl 4-chloro-3-(4,4-dimethyl-3-oxopentanamido)benzoate.

A mixture of the amino compound (47.0 g, 79.5 mmole) from (b), methyl pivaloyl acetate (15.2 g, 96.3 mmole) and heptane (250 ml), were heated under reflux for 48 hours, during which time methanol was continuously removed. The solution was evaporated to dryness and the residue crystallized from methanol (400 ml) to give the product (50.3 g, 88%), as a white solid, m.p. 130°-133°.

Found: C, 73.0; H, 8.5; Cl, 4.8; N, 1.9. $C_{44}H_{60}ClNO_5$ requires: C, 73.6; H, 8.4; Cl, 4.9; N, 2.0%.

(d) 2,4-Di-t-butyl-6-[1-(3,5-di-t-butyl-2-hydroxy phenyl)ethyl]phenyl 4-chloro-3-(2-chloro-4,4-dimethyl-3-oxopentanamido)benzoate. N-chlorosuccimide (10.2 g, 76.4 mmole) was added with stirring to a solution of the compound (50.0 g, 69.7 mmole) from (c) in chloroform (270 ml) and stirring continued for 48 hours. The mixture was washed with water (500 ml) and the chloroform solution dried and evaporated to dryness. The residue was crystallized from hexane (100 ml) to give the product (38.9 g, 74%), as a white solid, m.p. 196°-199°.

Found: C, 70.0; H, 8.0; Cl, 9.7; N, 1.8. $C_{44}H_{59}ClNO_5$ requires: C, 70.2; H, 7.8; Cl, 9.4; N, 1.9%.

(e) Coupler A9

Triethylamine (2.1 g, 21 mmole) was added with stirring to a mixture of the compound (5.3 g, 7.0 mmole) from (d), p-cyanophenol (1.0 g, 8.4 mmole) and N,N-dimethylformamide (30 ml) at 45°-50°. Heating and stirring were continued for a further 2 hours. The mixture was cooled and poured into an ice cold solution of water (300 ml) and 10M hydrochloric acid (120 ml). The solid was collected, dissolved in ethyl acetate (100 ml) and washed successively with warm 2M hydrochloric acid (75 ml), 1% sodium carbonate (4×75 ml) and water (75 ml). The ethyl acetate solution was evaporated and the residue crystallized from methanol (2×35 ml) to give the product (3.3 g, 57%), as a white solid, m.p. 170°-174°.

Found: C, 73.3; H, 7.6; Cl, 4.5; N, 3.3. $C_{51}H_{63}ClN_2O_6$ requires: C, 73.3; H, 7.5; Cl, 4.3; N, 3.4%.

Other couplers of this invention were prepared in a similar manner to coupler A9 from the appropriate starting materials.

The invention has been described in detail with particular reference to preferred embodiments thereof, but it will be understood that variations and modifications can be effected within the spirit and scope of the invention.

What is claimed is:

1. A color photographic element comprising a support bearing at least one photographic silver halide emulsion layer and a non-diffusible yellow dye-forming acetanilide coupler having a ballast group comprising a stabilizer moiety represented by the formula:

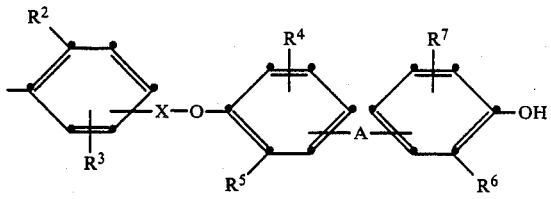

wherein $R^2$ is halogen or alkoxy having 1 to 4 carbon atoms;

$R^3$ is hydrogen, halogen, alkyl or alkoxy;

$R^4$, $R^5$, $R^6$ and $R^7$ are individually alkyl;

$$A \text{ is } -\overset{\overset{R^8}{|}}{\underset{\underset{R^9}{|}}{C}}-,\ -\overset{\overset{R^8}{|}}{\underset{\underset{R^9}{|}}{Si}}-,\ -\overset{\overset{R^{10}}{|}}{N}-,\ -O-,\ \text{or}\ -S-,$$

$R^8$ and $R^9$ are individually hydrogen or alkyl;

$R^{10}$ is hydrogen, alkyl or aryl; and,

X is a linking group.

2. A photographic element as in claim 1 wherein the coupler is represented by the formula:

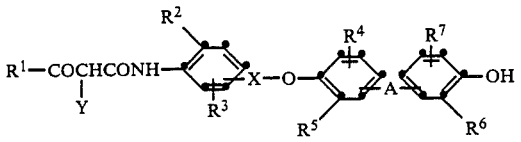

wherein $R^1$ is t-butyl or an unsubstituted or substituted aryl group;

$R^2$ is halogen or alkoxy having 1 to 4 carbon atoms;

$R^3$ is hydrogen, halogen, alkyl or alkoxy;

$R^4$, $R^5$, $R^6$ and $R^7$, are individually alkyl;

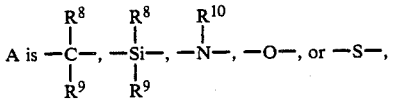

$R^8$ and $R^9$ are individually hydrogen or alkyl;

$R^{10}$ is hydrogen, alkyl or aryl;

X is a linking group; and,

Y is hydrogen or a coupling-off group.

3. A photographic element as in claim 1 wherein $R^2$ is chloro or methoxy.

4. A photographic element as in claim 1 wherein $R^3$ is hydrogen, chloro, methyl or methoxy.

5. A photographic element as in claim 1 wherein X is —CO—, —$SO_2$—, —$R^{11}$—, —O—, —$R^{11}$—O—, —O—$R^{11}$—, —O—$R^{11}$—CO—, —CO—$R^{11}$—O—, —O—$R^{11}$—O—, —NH—CO—$R^{11}$—, —$R^{11}$—CO—NH—, or —NH— where $R^{11}$ is an alkylene or alkylidene group.

6. A photographic element as in claim 2 wherein Y is an aryloxy, substituted aryloxy or heterocyclic coupling-off group.

7. A photographic element as in claim 2 wherein Y is a phenyloxy or substituted phenyloxy coupling-off group or one of the coupling-off groups:

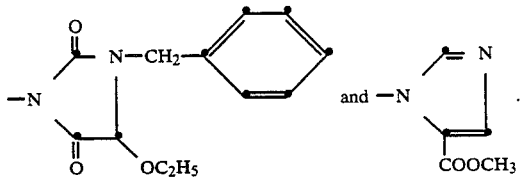

8. A photographic element as in claim 1 wherein the group comprising the stabilizer moiety is:

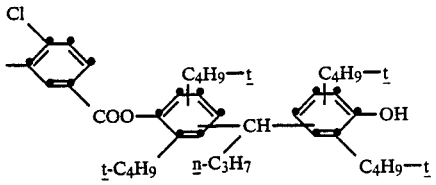

or

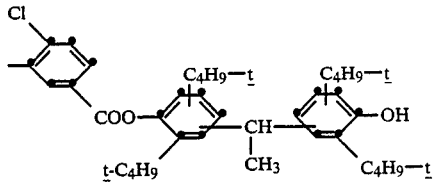

9. A photographic element as in claim 1 wherein the coupler is:

(A)

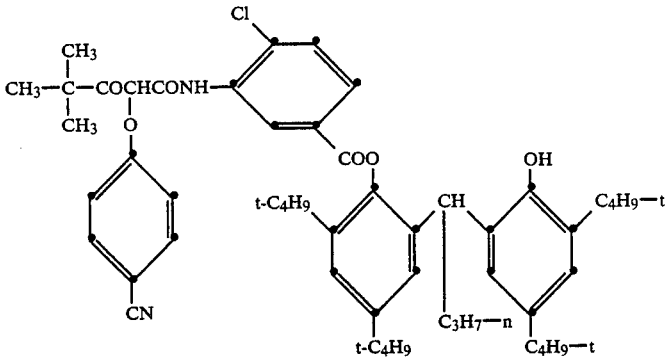

(B)

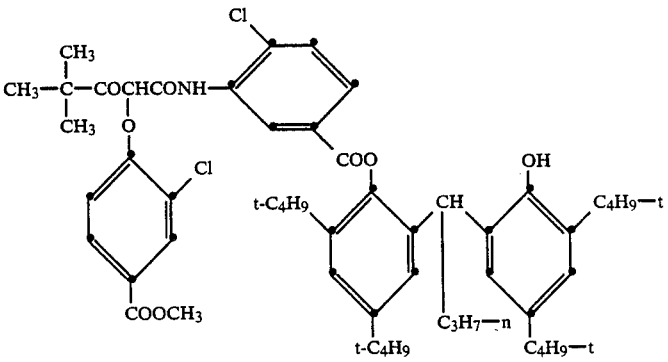

-continued
(C)
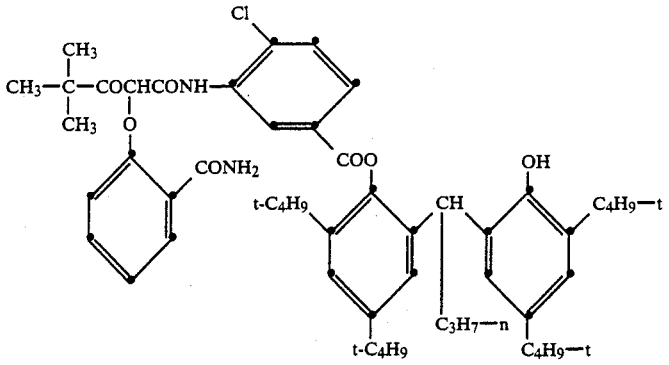
(D)
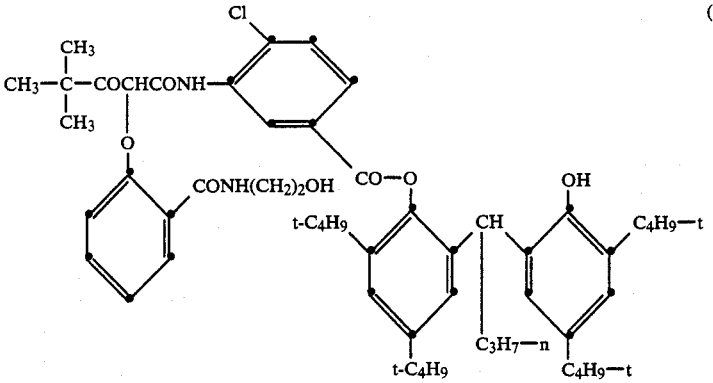
(E)
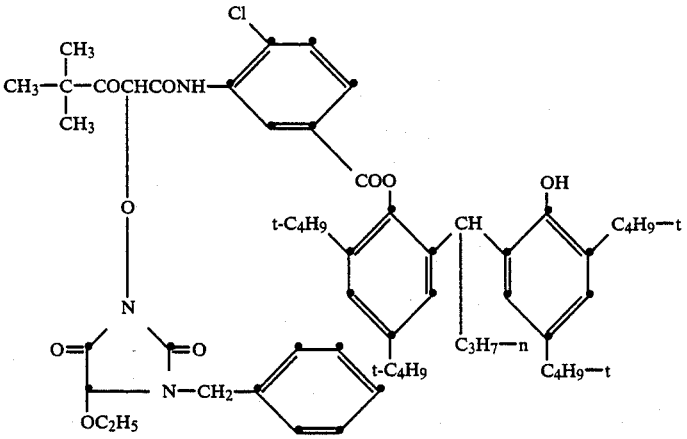
or

-continued (F)

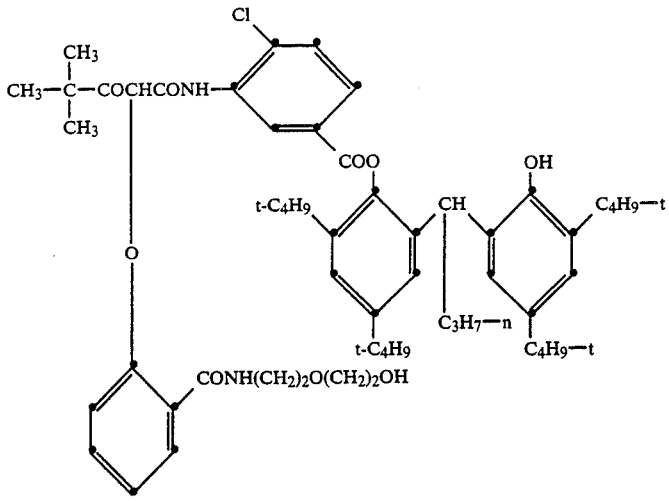

10. A color photographic element as in claim 1 comprising a red-sensitive silver halide emulsion unit having associated therewith at least one cyan dye-forming coupler; a green-sensitive silver halide emulsion unit having associated therewith at least one magenta dye-forming coupler; and, at least one blue-sensitive silver halide emulsion unit having associated therewith at least one yellow dye-forming coupler; and wherein said acetanilide coupler is associated with at least one of said units.

11. A process of forming a photographic image which comprises developing an exposed silver halide emulsion layer with a color developing agent in the presence of a yellow dye-forming acetanilide coupler as defined in claim 1.

12. A process as in claim 11 wherein the acetanilide coupler is:

(A)

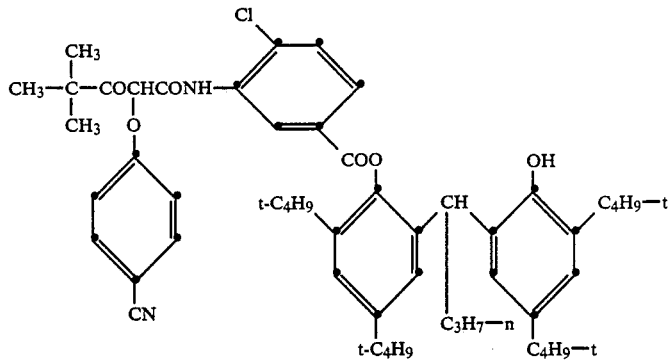

(B)

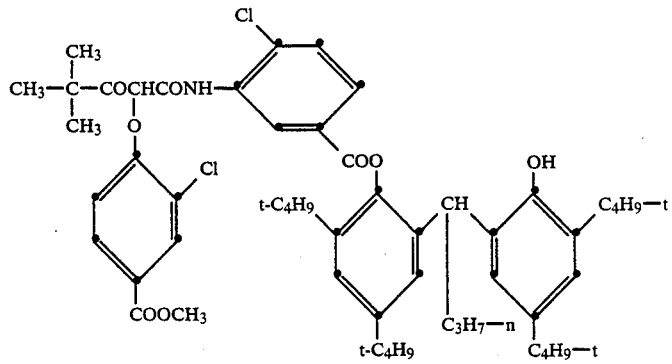

-continued
(C)
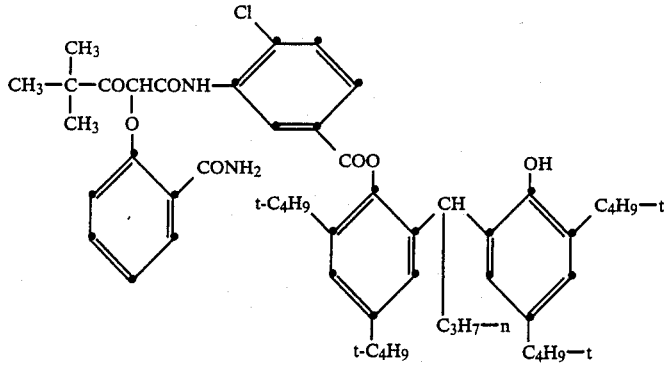
(D)
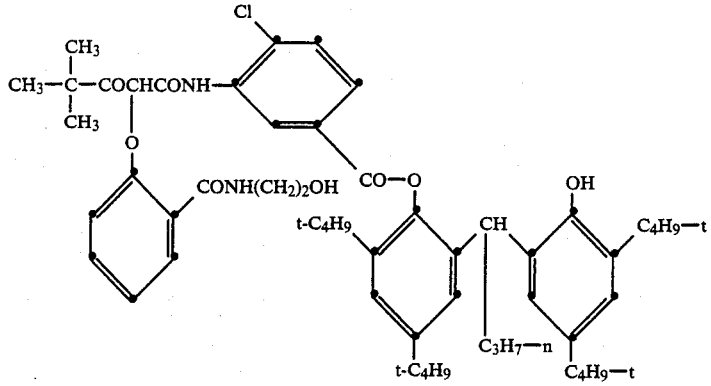
(E)
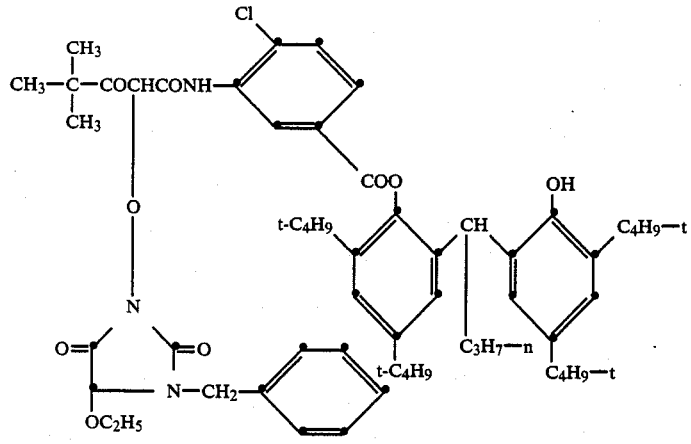
or

-continued
(F)
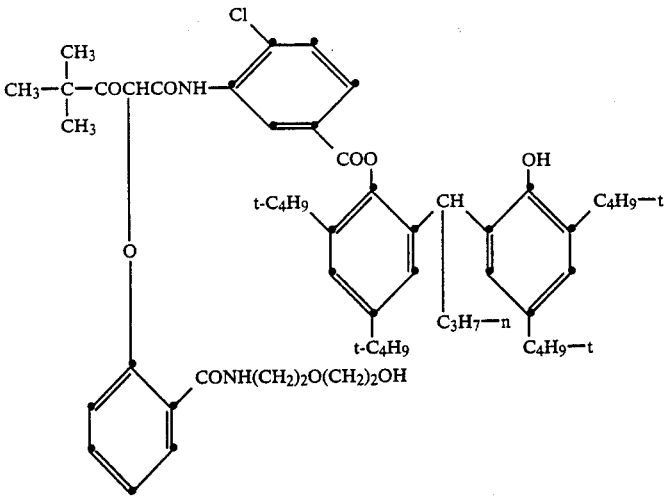
* * * * *